US006465143B2

(12) United States Patent
Tanaka et al.

(10) Patent No.: US 6,465,143 B2
(45) Date of Patent: Oct. 15, 2002

(54) ELECTROPHOTOGRAPHIC PHOTOSENSITIVE MEMBER, PROCESS CARTRIDGE AND ELECTROPHOTOGRAPHIC APPARATUS

(75) Inventors: Masato Tanaka, Shizuoka-ken; Hideki Anayama, Yokohama; Hidetoshi Hirano, Shizuoka-ken; Kan Tanabe, Susono; Kazue Asakura, Shizuoka-ken; Atsushi Fujii, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/768,052

(22) Filed: Jan. 24, 2001

(65) Prior Publication Data

US 2002/0061454 A1 May 23, 2002

(30) Foreign Application Priority Data

Jan. 31, 2000 (JP) ..... 2000-022610

(51) Int. Cl.[7] ..... G03G 5/06

(52) U.S. Cl. ..... 430/59.3; 430/72; 430/78; 399/116; 399/159

(58) Field of Search ..... 430/59.3, 77, 78; 399/116, 159

(56) References Cited

U.S. PATENT DOCUMENTS

| | | | | |
|---|---|---|---|---|
| 4,898,799 A | | 2/1990 | Fujimaki et al. | 430/59 |
| 4,963,450 A | | 10/1990 | Miyazaki et al. | 430/59 |
| 5,126,800 A | | 6/1992 | Shishido et al. | 355/211 |
| 5,206,437 A | | 4/1993 | Morita | 564/310 |
| 5,208,634 A | | 5/1993 | Ikemoto et al. | 355/215 |
| 5,302,479 A | | 4/1994 | Daimon et al. | 430/78 |
| 5,345,294 A | | 9/1994 | Nomura et al. | 355/200 |
| 5,358,813 A | | 10/1994 | Iijima et al. | 430/59 |
| 5,393,629 A | | 2/1995 | Nukada et al. | 430/76 |
| 5,610,690 A | | 3/1997 | Yoshihara et al. | 399/167 |
| 5,623,328 A | | 4/1997 | Tsuda et al. | 399/111 |
| 5,811,212 A | * | 9/1998 | Tanaka | 430/59.3 |
| 5,828,928 A | | 10/1998 | Sasago et al. | 399/111 |
| 5,885,737 A | | 3/1999 | Tanaka | 430/59 |
| 5,932,722 A | | 8/1999 | Hirai et al. | 540/139 |
| 6,049,685 A | | 4/2000 | Murakami et al. | 399/263 |

FOREIGN PATENT DOCUMENTS

| | | |
|---|---|---|
| EP | 0 803 779 A | 10/1997 |
| JP | 59-31962 | 2/1984 |
| JP | 61-217050 | 9/1986 |
| JP | 61-239248 | 10/1986 |
| JP | 62-67094 | 3/1987 |
| JP | 63-218768 | 8/1988 |
| JP | 64-17066 | 1/1989 |
| JP | 1-183663 | 7/1989 |
| JP | 5-98181 | 4/1993 |
| JP | 5-263007 | 10/1993 |
| JP | 7-128888 | 5/1995 |
| JP | 9-34149 | 2/1997 |
| JP | 10-67946 | 3/1998 |

OTHER PUBLICATIONS

Patent Abstracts of Japan, vol. 1998, No. 06 Apr. 30, 1998 (JP 10–048858).

Database WPI, Section Ch, Week 199723, Derwent Publications Ltd., London, GB; Class E21, AN 1997–249486, XP002167563 (JP 09 080779).

* cited by examiner

*Primary Examiner*—John Goodrow
(74) *Attorney, Agent, or Firm*—Fitzpatrick, Cella, Harper & Scinto

(57) ABSTRACT

An electrophotographic photosensitive member capable of forming images with less defects, such as ghost, while retaining a high photo-sensitivity, is provided. The photosensitive member includes a support and a photosensitive layer disposed on the support, wherein said photosensitive layer contains a phthalocyanine pigment and an azo calix [n]arene compound represented by the formula (1) below:

(1)

wherein n denotes an integer of 4–8; a number (n) of $R_1$ independently denote a hydrogen atom or an alkyl group capable of having a substituent and including at least one alkyl group capable of having a substituent; a number (2n) of $R_2$ independently denote a hydrogen atom or an alkyl group capable of having a substituent; and a number (n) of Ar independently denote a monovalent group selected from an aromatic hydrocarbon ring group capable of having a substituent, a heterocyclic ring group capable of having a substituent, and a combination of these groups capable of having a substituent.

18 Claims, 2 Drawing Sheets

ELECTROPHOTOGRAPHIC PHOTOSENSITIVE MEMBER, PROCESS CARTRIDGE AND ELECTROPHOTOGRAPHIC APPARATUS

FIELD OF THE INVENTION AND RELATED ART

The present invention relates to an electrophotographic photosensitive member, and a process cartridge and an electrophotographic apparatus including the electrophotographic photosensitive member.

As photoconductor materials for electrophotographic photosensitive members, inorganic photoconductors, such as cadmium sulfide, and zinc oxide, have been conventionally used. On the other hand, organic photoconductors, such as polyvinyl carbazole, oxadiazole, azo pigments and phthalocyanine have advantages of a non-pollution characteristic and high productivity compared with inorganic photoconductors but generally have a low conductivity so that the commercialization thereof has been difficult. For this reason, various sensitizing methods have been proposed, and among them, the use of a tunction separation-type photosensitive member including a charge generation layer and a charge transport layer in a laminated state has become predominant and have been commercialized.

On the other hand, in recent years, non-impact-type printers utilizing electrophotography have come into wide use in place of conventional impact-type printers as terminal printers. Such non-impact-type printers principally comprise laser beam printers using laser light as exposure light, and as the light source thereof, semiconductor lasers have been predominantly used, in view of the cost and apparatus size thereof. The semiconductor lasers principally used currently have an oscillating wavelength in a long wavelength region of 650–820 nm, so that electrophotographic photosensitive members having a sufficient sensitivity in such a long wavelength region have been developed.

Azo pigments and phthalocyanine pigments are very effective charge-generating materials having a sensitivity up to such a long wavelength region. Azo pigments are disclosed in, e.g., Japanese Laid-Open Patent Application (JP-A) 59-31962 and JP-A 1-183663. Further, compared with conventional phthalocyanine pigments, oxytitanium phthalocyanine and gallium phthalocyanine are known to have better sensitivities, and various- crystal forms thereof have been disclosed, e.g., in JP-A 61-239248, JP-A 61-217050, JP-A 62-67094, JP-A 63-218768, JP-A 64-17066, JP-A 5-98181, JP-A 5-263007 and JP-A 10-67946. Further, JP-A 7-128888 and JP-A 9-34149 have disclosed a combination of a specific azo pigment with a phthalocyanine pigment for providing improvements to problems accompanying such a phthalocyanine pigment. However, it is still desired to develop a photosensitive member capable of providing images free from image defects to a greater extent while retaining a high sensitivity characteristic.

While having such an excellent sensitivity characteristic, an electrophotographic photosensitive member using an azo pigment or a phthalocyanine pigment is accompanied by the difficulty that generated photocarriers are liable to remain in the photosensitive layer, thus functioning as a memory for causing a potential fluctuation. While the mechanism or principle thereof has not been fully confirmed or clarified as yet, it is assumed that the above difficulty is caused by the phenomenon that electrons left in the charge generation layer move for some reason to the boundary between the charge generation layer and the charge transport layer, or the boundary between the charge generation layer and the undercoating layer or the undercoating layer and an electroconductive layer therebelow, thereby increasing or decreasing the barrier characteristic against hole injection in the vicinity of the boundaries.

As actual phenomena occurring in electrophotographic photosensitive members, electrons remaining at the boundary between the charge generation layer and the charge transport layer result in a lowering in light-part potential or dark-part potential during continuous image formation. For example, in the so-called reversal development system frequently adopted in printers at present wherein a light-potential portion is developed with toner as an image portion while a dark-potential portion is left as a non-image portion, a portion of photosensitive member exposed in a previous printing cycle is caused to reach a light-part potential at a lower exposure quantity and is developed as a black ghost image in a white solid image area in a subsequent printing cycle, thus causing a noticeable ghost phenomenon (hereinafter called a "positive ghost").

On the other hand, electrons remaining at the boundary between the charge generation layer and the undercoating layer or between the undercoating layer and the electroconductive layer therebelow result in an increase (or an insufficient lowering) in light-part potential. When such a photosensitive member is used in the reversal development system, a portion of the photosensitive member exposed in a previous printing cycle is developed at a slower speed and is developed as a white ghost image in a back solid image area in a subsequent printing cycle, thus causing a noticeable ghost phenomenon (hereinafter called a negative ghost").

Among the above ghost phenomena, the negative ghost is liable to occur in an initial stage and the positive ghost is liable to occur in a later stage in a continuous printing operation (image formation). These ghost phenomena are noticeably observed especially in a photosensitive member including an undercoating adhesive layer for the charge generation layer and are particularly liable to occur in a low temperature/low humidity environment wherein the volume resistivity for electron movement in the charge generation layer and the undercoating layer is liable to increase so that the electrons are liable to remain abundantly in the charge generation layer.

SUMMARY OF THE INVENTION

An object of the present invention is to provide an electrophotographic photosensitive member capable of forming images free from image defects while retaining a high sensitivity, particularly in a semiconductor laser wavelength region.

Another object of the present invention is to provide a process cartridge and an electrophotographic apparatus including an electrophotographic photosensitive member as mentioned above.

According to the present invention, there is provided an electrophotographic photosensitive member, comprising a support and a photosensitive layer disposed on the support, wherein said photosensitive layer contains an azo calix[n] arene compound represented by the formula (1) below:

(1)

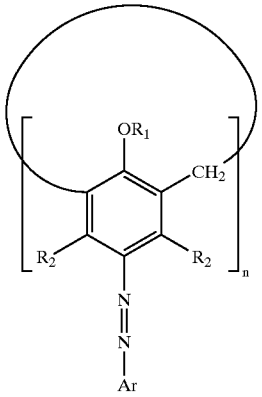

wherein n denotes an integer of 4–8; a number (n) of $R_1$ independently denote a hydrogen atom or an alkyl group capable of having a substituent and including at least one alkyl group capable of having a substituent; a number (2n) of $R_2$ independently denote a hydrogen atom or an alkyl group capable of having a substituent; and a number (n) of Ar independently denote a monovalent group selected from an aromatic hydrocarbon ring group capable of having a substituent, a heterocyclic ring group capable of having a substituent, and a combination of these groups capable of having a substituent.

The present invention further provides a process cartridge and an electrophotographic apparatus including the electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
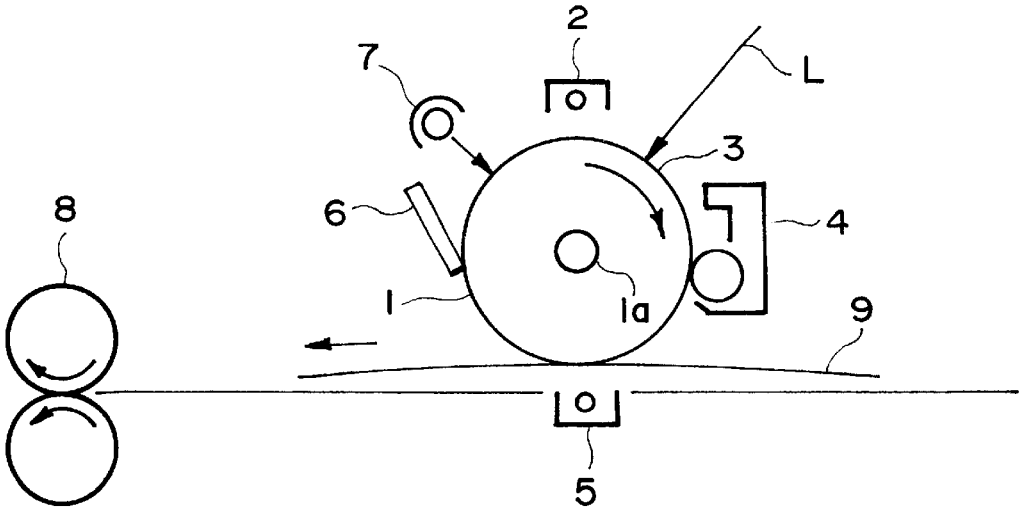
FIG. 1 is a schematic illustration of an electrophotographic apparatus including an electrophotographic photosensitive member according to the invention.

The azo calix[n]arene compound used in the present invention is a cyclic compound having 4 to 8 azo phenolic units (or azo phenol-aldehyde condensate units) represented by formula (1) below:

(1)

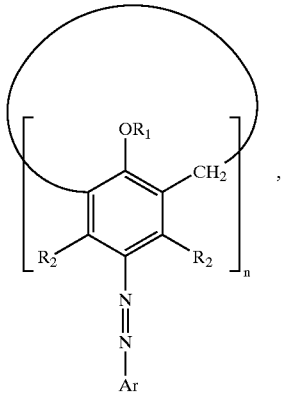

wherein n denotes an integer of 4–8; a number (n) of $R_1$ independently denote a hydrogen atom or an alkyl group capable of having a substituent and including at least one alkyl group capable of having a substituent; a number (2n) of $R_2$ independently denote a hydrogen atom or an alkyl group capable of having a substituent; and a number (n) of Ar independently denote a monovalent group selected from an aromatic hydrocarbon ring group capable of having a substituent, a heterocyclic ring group capable of having a substituent, and a combination of these groups capable of having a substituent.

Examples of the alkyl group for $R_1$ and $R_2$ in the formula (1) may include: methyl, ethyl, propyl, butyl and so on. It is however particularly preferred that $R_2$ is a hydrogen atom.

Further, examples the aromatic hydrocarbon ring group or heterocyclic group for Ar may include those derived from aromatic cyclic hydrocarbon compounds, such as benzene, naphthalene, fluorene, phenanthrene, anthracene, fluoranthene, and pyrene; heterocyclic groups, such as furan, thiophene, pyridine, indole, benzothiazole, carbazole, benzocarbazole, acridone, dibenzothiophene, benzooxazole, benzotriazole, oxathiazole, thiazole, phenazine, cinnoline, and benzocinnoline. Further, a plurality of these aromatic cyclic hydrocarbon compounds and/or heterocyclic compounds can be bonded to each other directly (via a single bond or condensed with each other) or via an aromatic or non-aromatic bonding group to provide the group Ar. Examples of such combined forms of compounds providing an Ar group may include: triphenylamine, diphenylamine, N-methyldiphenylamine, biphenyl, terphenyl, binaphthyl, fluorenone, phenanthrenequinone, anthraquinone, benzanthrone, diphenyloxazole, phenylbenzoxazole, diphenylmethane, diphenyl sulfone, diphenyl ether, benzophenone, stilbene,distyrylbenzene, tetraphenyl-p-phenylenediamine, and tetraphenylbenzidine.

Examples of the above-mentioned substituent optionally possessed by the groups $R_1$, $R_2$ and Ar may include: alkyl groups, such as methyl, ethyl, propyl and butyl; alkoxy groups, such as methoxy and ethoxy; dialkylamino groups, such as dimethylamino and diethylamino; halogen atoms, such as fluorine, chlorine and bromine; hydroxy, nitro, cyano, and halomethyl.

In the formula, n is an integer of 4–8, and 4 to 8 groups $R_1$ or 4 to 8 groups Ar may respectively be identical or different from each other. Further, 8 to 16 groups $R_2$ can be identical or different from each other.

Some specific examples of the azo calix[n]arene compound represented by the above-mentioned general formula (1) used in the present invention are enumerated hereinbelow by way of tables indicating examples of groups $R_3$–$R_{21}$ and $Ar_1$–$Ar_3$ included in Basic formulae I–III shown below:

Basic Formula I

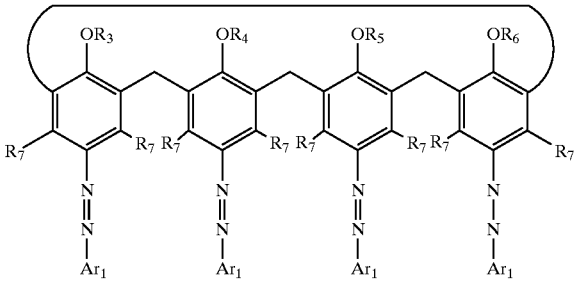

| | Compound (1) | Compound (2) | Compound (3) | Compound (4) | Compound (5) | Compound (6) |
|---|---|---|---|---|---|---|
| $R_3$ | $—CH_2CH_2CH_3$ | $—CH_2CH_2CH_3$ | $—CH_2CH_2CH_3$ | $—CH_3$ | $—CH_2CO_2CH_2CH_3$ | $—CH(CH_3)_2$ |
| $R_4$ | H | H | $—CH_2CH_2CH_3$ | H | H | H |
| $R_5$ | $—CH_2CH_2CH_3$ | $—CH_2CH_2CH_3$ | $—CH_2CH_2CH_3$ | $—CH_3$ | $—CH_2CO_2CH_2CH_3$ | $—CH(CH_3)_2$ |
| $R_6$ | H | H | $—CH_2CH_2CH_3$ | H | H | H |
| $R_7$ | H | H | H | H | H | H |
| $Ar_1$ | 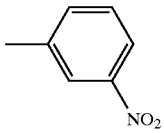 | 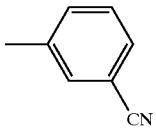 | 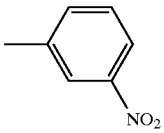 | 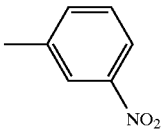 | 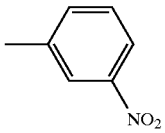 | 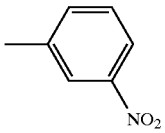 |

| | Compound (7) | Compound (8) | Compound (9) | Compound (10) | Compound (11) |
|---|---|---|---|---|---|
| $R_3$ | $—CH_2CH_2CH_3$ | $—CH_2CH_2CH_3$ | $—CH_2CH_2CH_3$ | $—CH_2CH_2CH_3$ | $—CH_2CH_2CH_3$ |
| $R_4$ | H | H | H | H | $—CH_2CH_2CH_3$ |
| $R_5$ | $—CH_2CH_2CH_3$ | $—CH_2CH_2CH_3$ | $—CH_2CH_2CH_3$ | $—CH_2CH_2CH_3$ | $—CH_2CH_2CH_3$ |
| $R_6$ | H | H | H | H | $—CH_2CH_2CH_3$ |
| $R_7$ | $—CH_3$ | $—CH_3$ | H | H | H |
| $Ar_1$ | 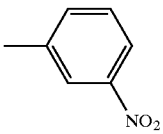 | 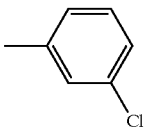 | 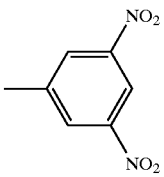 | 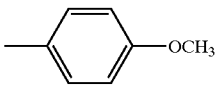 | 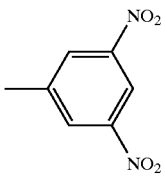 |

| | Compound (12) | Compound (13) | Compound (14) | Compound (15) | Compound (16) |
|---|---|---|---|---|---|
| $R_3$ | $—CH_3$ | $—CH_2CH_2CH_3$ | $—CH_2CH_2CH_3$ | $—CH_2CH_2CH_3$ | $—CH_2CH_2CH_3$ |
| $R_4$ | H | H | H | H | H |
| $R_5$ | $—CH_3$ | $—CH_2CH_2CH_3$ | $—CH_2CH_2CH_3$ | $—CH_2CH_2CH_3$ | $—CH_2CH_2CH_3$ |
| $R_6$ | H | H | H | H | H |
| $R_7$ | H | H | H | H | H |
| $Ar_1$ | 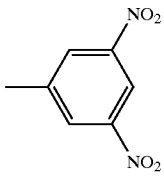 | 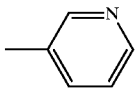 | 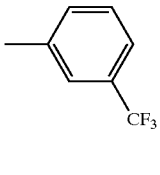 | 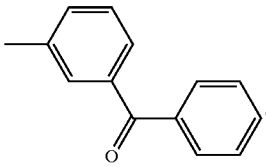 | 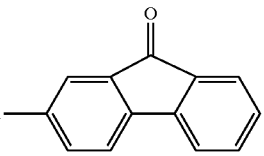 |

Basic Formula II

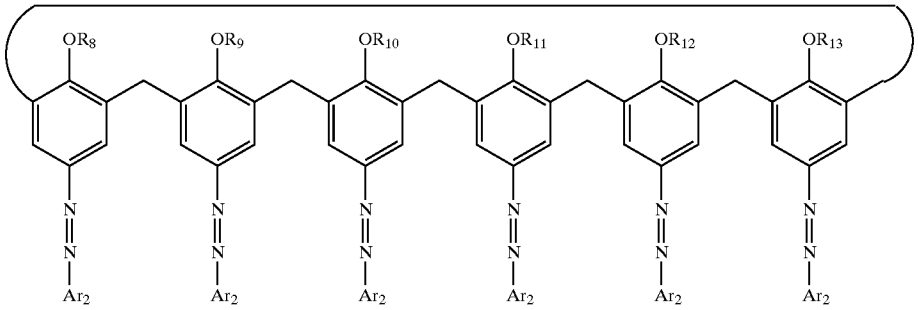

| | Compound (17) | Compound (18) | Compound (19) | Compound (20) |
|---|---|---|---|---|
| $R_6$~$R_{13}$ | $—CH_2CH_2CH_3$ | $—CH_3$ | $—CH_3$ | $—CH_3$ |
| $Ar_3$ | 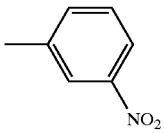 | 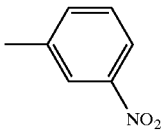 | 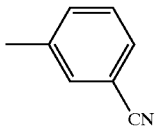 | 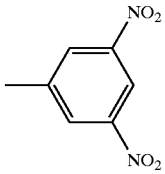 |

Basic Formula III

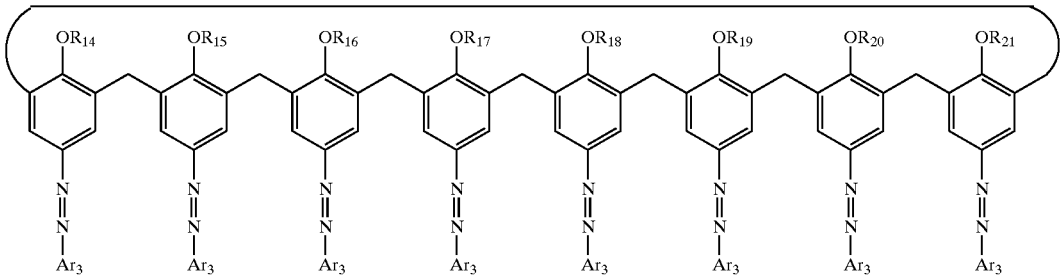

| | Compound (21) | Compound (22) | Compound (23) | Compound (24) |
|---|---|---|---|---|
| $R_{14}$~$R_{21}$ | $—CH_2CH_2CH_3$ | $—CH_3$ | $—CH_2CH_2CH_3$ | $—CH_3$ |
| $Ar_3$ | 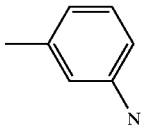 | 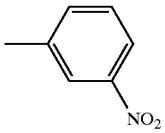 | 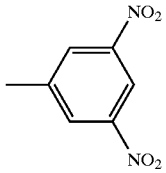 | 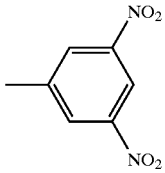 |

Among the above-mentioned specific example compounds, Compounds 1–12 and 17–24 are preferred; Compounds 1, 3, 9 and 18 are further preferred; and Compound 1 is particularly preferred.

An azo calix[n]arene compound of the above formula (1) may be synthesized by reacting an azo calix[n]arene compound of which all (4–8) groups $R_1$ are all hydrogen atoms, with an alkyl halide in the presence of an alkali for treatment of the phenolic OH groups. The species of the alkyl group to be introduced and the degree of alkylation can be controlled depending on the species and amount of the alkyl halide and the reaction conditions including the species of the alkali. Examples of the alkali may include: sodium hydroxide, potassium hydroxide, barium hydroxide, sodium carbonate, potassium carbonate, and caesium carbonate. Examples of the alkyl halide may include: iodomethane, iodoeethane, 1-iodopropane, 1-bromopropane, 2-iodopropane, 1-iodobutane, ethyl bromoactate, ethyl bromolactate, and chloromethyl methyl ether.

In addition to the above method, the azo calix[n]arene compound of the formula (1) may also be synthesized by a method using diazomethane for the treatment or a method using dimethyl sulfate/barium hydroxide.

In the following description, "part(s)" means "part(s) by weight".

SYNTHESIS EXAMPLE

<Synthesis of Compound 1>

In a nitrogen atmosphere, 10 parts of the following compound was dispersed in 500 parts of N,N-dimethylformamide

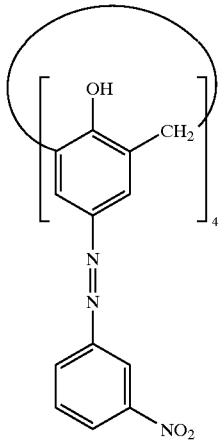

and then 9.5 parts of barium hydroxide octa-hydrate and 8.9 parts of barium oxide were added thereto, followed by stirring for 30 min. at 40° C. Into the solution, 51 parts of 1-iodopropane was added dropwise, and the system was stirred for 2 hours at that temperature, followed by addition into 5000 parts of 1N-hydrochloric acid, extraction with chloroform, washing with water, drying on magnesium sulfate and distilling-off of the solvent. The residue was purified by silica gel column chromatography with toluene as the developing solvent to obtain 9.5 parts (yield: 83%) of Compound (1) listed above in the form of a yellow crystal.

Compound (1) thus obtained exhibited the following $^1$H-NMR and 1R data:

$^1$NMR ($CdCl_3$, 24° C.): δ 1.41 (t, 6H, J=7.3 Hz), 2.19 (m, 4H), 3.72 (d, 4H, J=13.2 Hz), 4.15 (t, 4H, J=6.1 Hz), 4.47 (d, 4H, J=13.2 Hz), 7.40 (t, 2H, J=8.1 Hz), 7.56 (t, 2H, J=8.1 Hz), 7.60 (s, 4H), 7.90 (d, 2H, J=8.1 Hz), 7.95 (s, 4H), 8.07 (d, 2H), 8.15 (d, 2H), 8.20 (d, 2H, J=8.1 Hz), 8.39 (s, 2H), 8.68 (s, 2H), 8.84 (s, 2H). IR (KBr): 3435, 1529, 1350 $cm^{-1}$

From these data, it was confirmed that the thus-obtained compound was Compound (1).

In the present invention, it is preferred that the azo calix[n]arene compound of the formula (1) is used in combination with a charge-generating material, which may preferably be an azo pigment or a phthalocyanine pigment.

Any azo pigments, inclusive of bisazo, trisazo and tetrakisazo pigments, may be used, but benzanthrone-type azo pigments as disclosed by JP-A 59-31962 and JP-A 1-183663 are preferred because of their excellent sensitivity characteristic in spite of their ability to generate a ghost, which can be effectively suppressed by the co-presence of the azo calixarene compound according to the present invention.

Any phthalocyanine pigments may be used, inclusive of metal-free phthalocyanines and metal phthalocyanines further capable of having ligands, but oxytitanium phthalocyanine and gallium phthalocyanine are preferred because of their excellent sensitivity characteristic in spite of their ability to generate a ghost, which can be effectively suppressed by the co-presence of the azo calixarene compound according to the present invention. These phthalocyanines may basically have any crystal form. In view of their excellent sensitivities, however, it is preferred to use hydroxygallium phthalocyanine having a crystal form characterized by strong peaks at Bragg angles (2θ±0.2 deg.) of 7.4 deg. and 28.2 deg.; chlorogallium phthalocyanine having a crystal form characterized by strong peaks at Bragg angles (2θ±0.2 deg.) of 7.4 deg., 16.6 deg., 25.5 deg. and 28.3 deg.; or oxytitanium phthalocyanine having a crystal form characterized by strong peaks at a Bragg angle (2θ±0.2 deg.) of 27.2 deg., respectively according to CuKα-characteristic X-ray diffractometry. It is further preferred to use hydroxygallium phthalocyanine having a crystal form characterized by strong peaks at Bragg angles (2θ±0.2 deg.) of 7.4 deg. and 28.2 deg.; or oxytitanium phthalocyanine having a crystal form characterized by strong peaks at a Bragg angle (2θ±0.2 deg.) of 27.2 deg., respectively according to CuKα-characteristic X-ray diffractometry. More specifically, it is preferred to use hydroxygallium phthalocyanine having a crystal form characterized by strong peaks at Bragg angles, (2θ±0.2 deg.) of 7.3 deg., 24.9 deg. and 28.1 deg.; hydroxygallium phthalocyanine having a crystal form characterized by strong peaks at Bragg angles (2θ±0.2 deg.) of 7.5 deg., 9.9 deg., 16.3 deg., 18.6 deg., 25.1 deg. and 28.3 deg.; oxytitanium phthalocyanine having a crystal form characterized by strong peaks at Bragg angles (2θ±0.2 deg.) of 9.0 deg., 14.;2 deg., 23.9 deg. and 27.1 deg.; or oxytitanium phthalocyanine having a crystal form characterized by strong peaks at Bragg angles (2θ±0.2 deg.) of 9.5 deg., 9.7 deg., 11.7 deg., 15.0 deg., 15.0 deg., 23.5 deg., 24.1 deg. and 27.3 deg., respectively according to CuKα-characteristic X-ray diffractometry.

In the electrophotographic photosensitive member according to the present invention, the photosensitive layer on the support may have a single photosensitive layer structure containing the azo calix[n]arene of the formula (1), a charge-generating material and a charge-transporting material in mixture in a single photosensitive layer, or a laminated photosensitive layer structure including a charge generation layer containing both the azo calix[n]arene of the formula (1) and a charge-generating material, and a charge transport layer containing a charge-transporting material, disposed in this order or a reverse order on a support. It is preferred that the charge generation layer is disposed below the charge transport layer.

The support may comprise any material showing electroconductivity. For example, the support may comprise a metal such as aluminum or stainless steel, or a base structure of a metal, plastic or paper coated with an electroconductive layer. The support may assume a shape of a cylinder, a flat sheet or an endless belt.

It is possible to dispose an undercoating layer showing a barrier function and an adhesive function between the support and the photosensitive layer. The undercoating layer may comprise a material, such as polyvinyl alcohol, polyethylene oxide, ethyl cellulose, methyl cellulose, casein, polyamide, glue or gelatin. These materials may be dissolved in an appropriate solvent and applied on the support to form an undercoating layer of, e.g., 0.2–3.0 μm in thickness.

It is sometimes suitable to dispose an electroconductive layer between the support and the undercoating layer for the purpose of coating of irregularity or defects on the support or preventing the occurrence of interference fringes. Such an electroconductive layer may be formed in a thickness of 5–40 μm, preferably 10–30μm, by application of a coating liquid formed by disposing electroconductive powder of carbon black, metal or metal oxides in a solution of a binder resin.

The single photosensitive layer may be formed by applying a coating liquid comprising a mixture of an azo calix[n]arene of the formula (1), a charge-generating material and a charge-transporting material within a solution of a binder resin on the support optionally coated with the undercoating layer, etc., followed by drying of the coating liquid.

For providing the laminated photosensitive layer, the charge generation layer may be formed by application of a coating liquid formed by dispersing the azo calix[n]arene of the formula (1) and a charge-generating material in a solution of an appropriate binder, followed by drying of the coating liquid. The charge transport layer may be formed by application of a coating liquid formed by dissolving a charge transporting material and a binder resin in a solvent, followed by drying of the coating liquid.

Examples of the charge-transporting material may include: various triarylamine compounds, hydrazone compounds, stilbene compounds, pyrazoline compounds, oxazole compounds, thiazole compounds, and triarylmethane compounds. As a charge-transporting material suitably combined with the phthalocyanine pigment and the azo calix[n]arene of the formula (1), it is preferred to use a triarylamine compound.

Examples of the binder resin for providing the respective layers may include: polyester, acrylic resin, polyvinylcarbazole, phenoxy resin, polycarbonate, polyvinyl butyral, polystyrene, polyvinyl acetate, polysulfone, polyarylate, polyvinylidene chloride, arylonitrile copolymer and polyvinylbenzal. As a resin for dispersing the azo calix[n]arene of the formula (1) in the present invention, it is preferred to use polyvinyl butyral or/and polyvinyl benzal.

For the formation of the photosensitive layers, various coating methods may be adopted, inclusive of dipping, spray coating, spinner coating, bead coating, blade coating and beam coating.

A photosensitive layer of a single-layer structure may preferably have a thickness of 5–40 $\mu$m, particularly 10–30 $\mu$m. In a laminated photosensitive layer structure, the charge generation layer may preferably have a thickness of 0.01–10 $\mu$m, particularly 0.05–5 $\mu$m, and the charge transport layer may preferably have a thickness of 5–40 $\mu$m, particularly 10–30 $\mu$m.

In the laminated photosensitive layer structure, the azo calix[n]arene compound may preferably be contained in 0.0001–10 wt. %, more preferably 0.001–5 wt. %, of the total weight of the charge generation layer. The charge-generating material may preferably be contained in 30–90 wt. %, more preferably 50–80 wt. %, of the total weight of the charge generation layer. The charge-transporting material may preferably be contained in 20–80 wt. %, more preferably 30–70 wt. %, of the total weight of the charge transport layer.

In the single-layered photosensitive layer structure, the azo calix[n]arene compound may preferably be contained in 0.00001–1 wt. %, the charge-generating material may preferably be contained in 3–30 wt. %, and the charge-transporting material may preferably be contained in 30–70 wt. %, respectively of the total weight of the photosensitive layer.

In any case, it is preferred that the azo calix[n]arene compound of the formula (1) is contained in 0.3–10 wt. %, particularly 0.5–5 wt. %, of the charge-generating material.

The photosensitive layer can be further coated with a protective layer as desired. Such a protective layer may be formed in a thickness of preferably 0.05–20 $\mu$m by application of a solution in an appropriate solvent of a resin, such as polyvinyl butyral, polyester, polycarbonate (polycarbonate Z, modified polycarbonate, etc.), nylon, polyimide, polyarylate, polyurethane, styrene-butadiene copolymer, ethylene-acrylic acid copolymer, styrene-acrylonitrile copolymer, or curable resin precursor, followed by drying and optional curing. The protective layer can further contain electroconductive particles of, e.g., metal oxides, such as tin oxide, an ultraviolet absorber, etc.

Next, some description will be made on the electrophotographic apparatus according to the present invention.

Referring to FIG. 1, a photosensitive member 1 in the form of a drum is rotated about an axis la at a prescribed peripheral speed in the direction of the arrow shown inside of the photosensitive member 1. The peripheral surface of the photosensitive member 1 is uniformly charged by means of a primary charger 2 to have a prescribed positive or negative potential. At an exposure part 3, the photosensitive member 1 is imagewise exposed to light L (as by slit exposure or laser beam-scanning exposure) by using an image exposure means (not shown), whereby an electrostatic latent image is successively formed corresponding to the exposure pattern on the surface of the photosensitive member 1. The thus formed electrostatic latent image is developed by using a developing means 4 to form a toner image. The toner image is successively transferred to a transfer(-receiving) material 9 which is supplied from a supply part (not shown) to a position between the photosensitive member 1 and a transfer charger 5 in synchronism with the rotation speed of the photosensitive member 1, by means of a corona transfer charger 5. The transfer material 9 carrying the toner image thereon is separated from the photosensitive member 1 to be conveyed to a fixing device 8, followed by image fixing to print out the transfer material 9 as a copy outside the electrophotographic apparatus. Residual toner particles remaining on the surface of the photosensitive member 1 after the transfer operation are removed by a cleaning means 6 to provide a cleaned surface, and residual charge on the surface of the photosensitive member 1 is erased by a pre-exposure means 7 to prepare for the next cycle.

Figure 2:
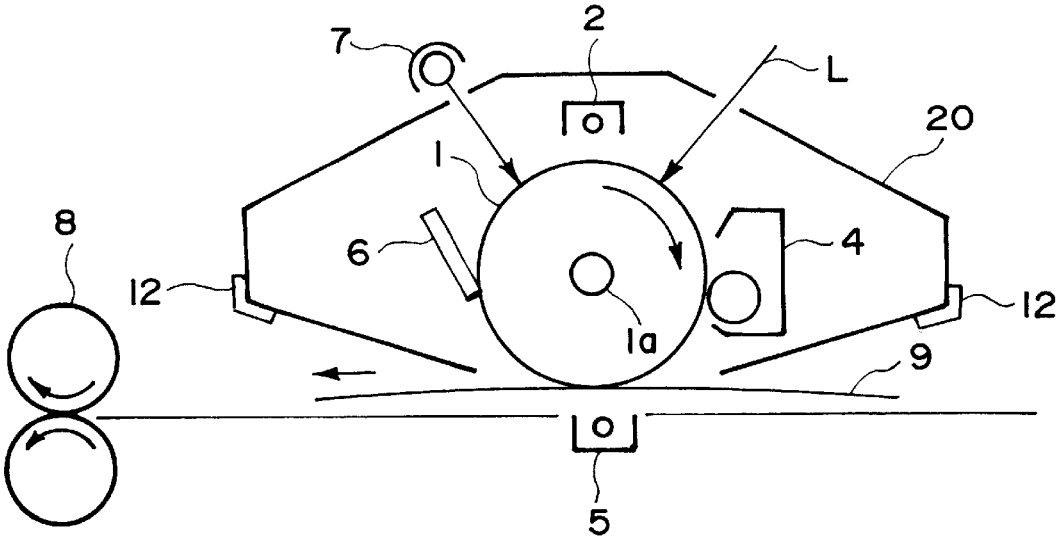
FIGS. 2 to 4 are schematic illustrations of electrophotographic apparatus including different types of process cartridge each including an electrophotographic photosensitive member according to the invention.

FIG. 2 shows an electrophotographic apparatus wherein an electrophotographic photosensitive member 1, a charging means 2 and a developing means 4 are integrally stored in a container 20 to form a process cartridge, which is detachably mountable to a main assembly of the electrophotographic apparatus by the medium of a guiding means, such as a rail of the main assembly. A cleaning means 6 may be disposed as shown or not disposed within the container 20.

Figure 3:
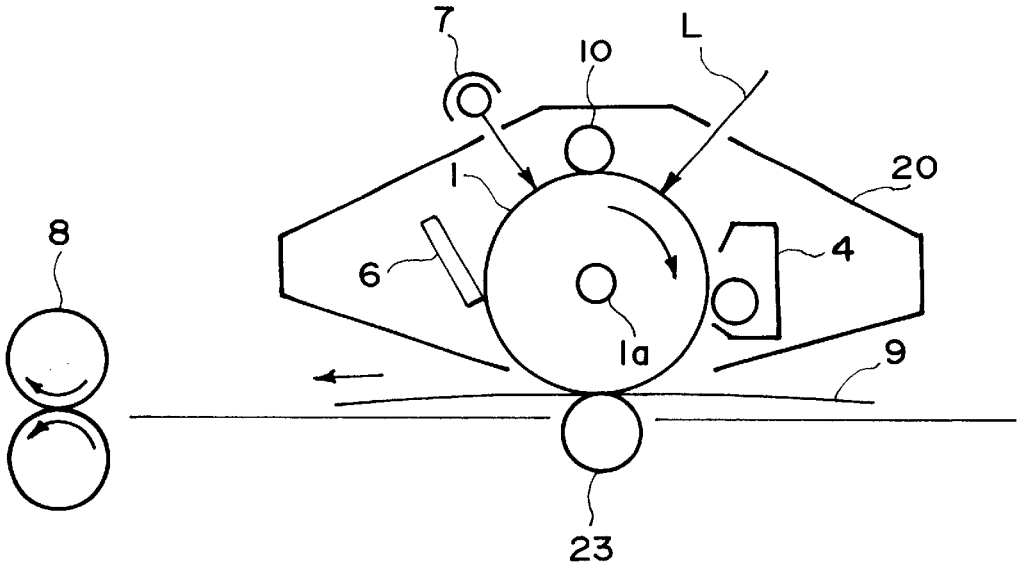
Figure 4:
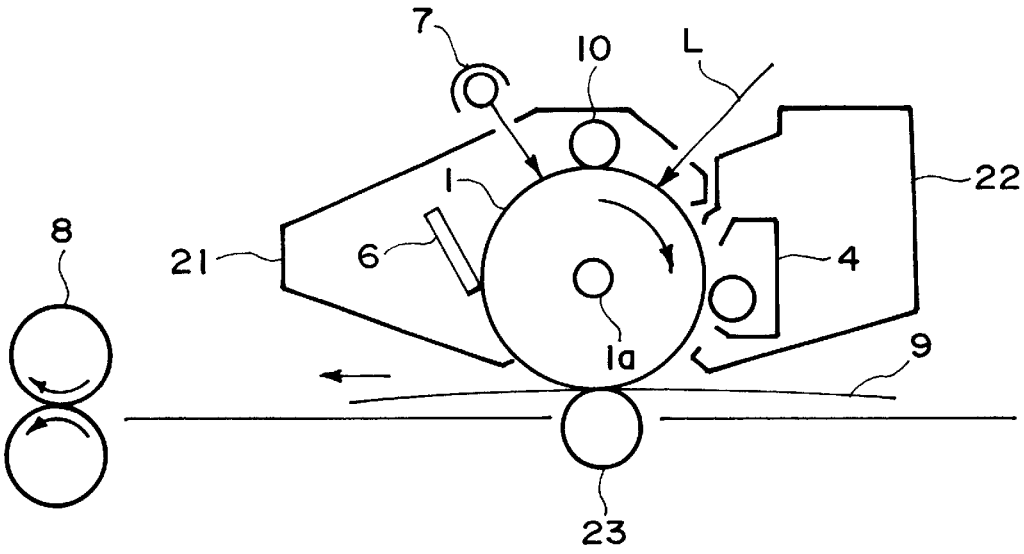

FIGS. 3 and 4 show other embodiments of the electrophotographic apparatus according to the present invention including different forms of process cartridges wherein a contact charging member 10 supplied with a voltage as a charging means is caused to contact a photosensitive member 1 to charge the photosensitive member 1. In the apparatus of FIGS. 3 and 4, toner images on the photosensitive member 1 are transferred onto a transfer material P also by means of a contact charging member 23. More specifically, a contact charging member 23 supplied with a voltage is caused to contact a transfer material, whereby a toner image on the photosensitive member 1 is transferred onto the transfer material 9.

Further, in the apparatus of FIG. 4, at least the photosensitive member 1 and the contact charging member 10 are stored within a first container 21 to form a first process cartridge, and at least the developing means 4 is stored within a second container 22 to form a second process cartridge; so that the first and second process cartridges are detachably mountable to the main assembly of the electrophotographic apparatus. A cleaning means 6 may be disposed as shown or not disposed within the container 21. In the case where the electrophotographic apparatus constitutes a copying machine or a printer, the exposure light L may be provided as reflected light or transmitted light from an original, or alternatively provided as image-carrying illumination light formed by reading an original by a sensor, converting the read data into signals and driving a laser beam scanner, an LED array or a liquid crystal shutter array.

Hereinbelow, the present invention will be described more specifically with reference to Examples and Comparative Examples wherein "parts" and "%" used for describing a relative amount of a component or a material are by weight unless specifically noted otherwise.

Example 1

50 parts of titanium oxide powder coated with tin oxide containing 10% of antimony oxide, 25 parts of resol-type phenolic resin, 20 parts of methyl cellosolve, 5 parts of methanol and 0.002 part of silicone oil (polydimethylsiloxane-polyoxyalkylene copolymer, average molecular weight=3000), were dispersed for 2 hours in a sand mill containing 1 mm-dia. glass beads, to prepare an electroconductive paint. An aluminum cylinder (of 30 mm in diameter and 260.5 mm in length) was coated by dipping within the above-prepared electroconductive paint, followed by drying at 140° C. for 30 min. to form a 20 μm-thick electroconductive layer.

The aluminum cylinder was further coated by dipping within a solution of 5 parts of 6-66-610-12 quaternary polyamide copolymer resin in a solvent mixture of 70 parts of methanol and 25 parts of butanol, followed by drying, to form a 1 μm-thick undercoating layer.

Separately, 10 parts of hydroxygallium phthalocyanine having a crystal form characterized by strong peaks at Bragg angles (274 ±0.2 deg.) of 7.5 deg., 9.9 deg., 16.3 deg., 18.6 deg., 25.1 deg. and 28.3 deg., 0.01 part of Compound (1) described before and 5 parts of polyvinyl butyral resin ("S-LEC BX-1", available from Sekisui Kagaku Kogyo K.K.), were added to 250 parts of cyclohexanone, and the mixture was subjected to 1 hour of dispersion in a sand mill containing 1 mm-dia. glass beads and then diluted with 250 parts of ethyl acetate to obtain a paint. The paint was applied by dipping onto the undercoating layer and dried at 100° C. for 10 min. to form a 0.16 μm-thick charge generation layer.

Then, 10 parts of a charge-transporting material of the following structural formula:

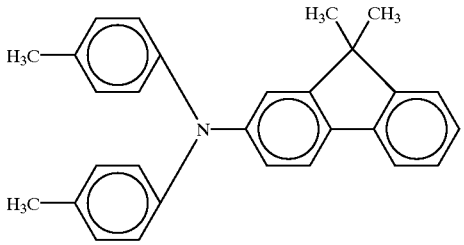

and 10 pats of polycarbonate resin ("IUPILON Z-200", available from Mitsubishi Gas Kagaku K.K.) were dissolved in 70 parts of monochlorobenzene to form a coating solution, which was then applied by dipping on the above-formed charge generation layer on the aluminum cylinder and dried at 110° C. for 1 hour, to form a 25 μm-thick charge transport layer, thus providing an electrophotographic photosensitive member.

Example 2

An electrophotographic photosensitive member was prepared in the same manner as in Example 1 except for reducing the amount of Compound (1) to 0.001 part in the charge generation layer-forming paint.

Example 3

An electrophotographic photosensitive member was prepared in the same manner as in Example 1 except for increasing the amount of Compound (1) to 0.1 part in the charge generation layer-forming paint.

Example 4

An electrophotographic photosensitive member was prepared in the same manner as in Example 1 except for using Compound (3) described before instead of Compound (1) in the charge generation layer-forming paint.

Example 5

An electrophotographic photosensitive member was prepared in the same manner as in Example 1 except for using Compound (9) described before instead of Compound (1) in the charge generation layer-forming paint.

Example 6

An electrophotographic photosensitive member was prepared in the same manner as in Example 1 except for using Compound (18) described before instead of Compound (1) in the charge generation layer-forming paint.

Example 7

An electrophotographic photosensitive member was prepared in the same manner as in Example 1 except for replacing the hydroxygallium phthalocyanine with oxytitanium phthalocyanine having a crystal form characterized by strong peaks at Bragg angles (2θ±0.2 deg.) of 9.0 deg., 14.2 deg., 23.9 deg. and 27.1 deg. in the charge generation layer-forming paint.

Example 8

The steps of Example 1 were repeated up to the formation of the charge generation layer.

Then, 10 parts of a charge-transporting material of the following structural formula:

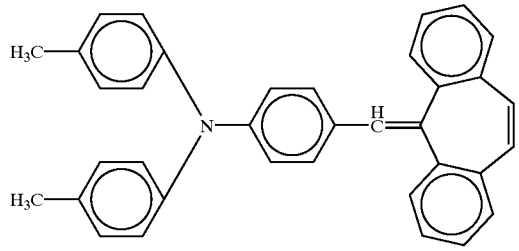

and 10 parts of polycarbonate resin ("IUPILON Z-400", available from Mitsubishi Gas Kagaku K.K.) were dissolved in 100 parts of monochlorobenzene to form a coating solution, which was then applied by dipping on the above-formed charge generation layer and dried at 150° C. for 30 min. to form a 15 μm-thick charge transport layer, thus providing an electrophotographic photosensitive member.

Example 9

The steps of Example 1 were repeated up to the formation of the charge generation layer.

Then, 7 parts of a charge-transporting material of the following structural formula:

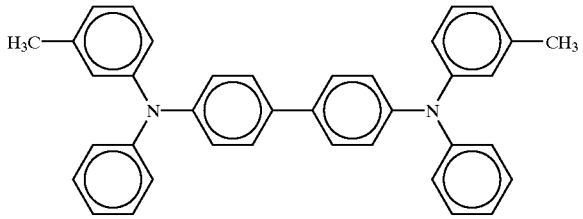

3 parts of a charge-transporting material of the following structural formula:

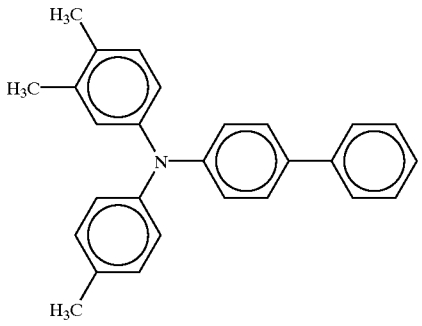

and 10 parts of polycarbonate resin ("IUPILON Z-200", available from Mitsubishi Gas Kagaku K.K.) were dissolved in 70 parts of monochlorobenzene to form a coating solution, which was then applied by dipping on the above-formed charge generation layer and dried at 110° C. for 30 min. to form a 32$\mu$m-thick charge transport layer, thus providing an electrophotographic photosensitive member.

Comparative Example 1

An electrophotographic photosensitive member was prepared in the same manner as in Example 1 except for omitting Compound (1) from the charge generation layer-forming paint.

Comparative Example 2

An electrophotographic photosensitive member was prepared in the same manner as in Example 7 except for omitting Compound (1) from the charge generation layer-forming paint.

Comparative Example 3

An electrophotographic photosensitive member was prepared in the same manner as in Example 1 except for replacing Compound 1 (azo calix[4]arene compound) in the charge generation layer-forming paint with 3 parts of a bisazo pigment of the following structural formula:

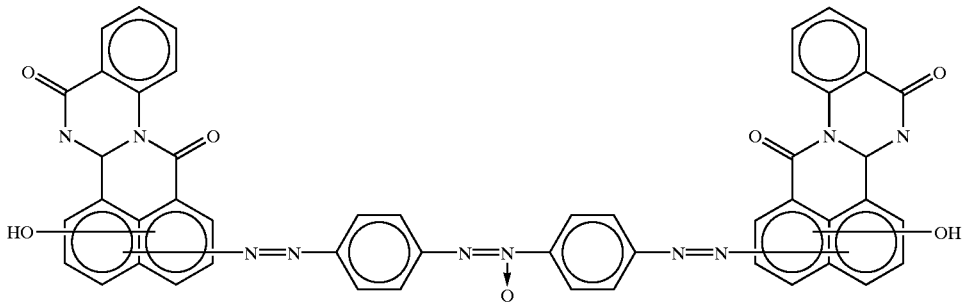

Each of the above-prepared electrophotographic photosensitive members was evaluated with respect to light-part potential ($V_L$) and ghost images by incorporating it into a process cartridge of a commercially available laser beam printer ("Laser Jet 4000", available from Hewlett-Packard Co.) after remodeling for allowing potential measurement on the photosensitive member. More specifically, first, in an environment of 23° C. and 55% RH, light part potential measurement and ghost image evaluation were performed at an initial stage, and then a continual image formation was performed on 1000 sheets. Then, the light-part potential ($V_L$) measurement and ghost image evaluation were performed immediately after and 15 hours after the continual image formation. In any case, the photosensitive member was primarily charged to provide a dark potential ($V_D$) of 600 volts.

Then, each photosensitive member and the laser beam printer were left standing for 3 days in a low temperature/low humidity environment of 15° C./10% RH, and then the light-part potential ($V_L$) measurement and ghost image evaluation were again performed.

The continual image formation was performed according to an intermittent mode at a rate of 4 sheets/min. for reproducing ca. 0.5 mm-wide lines at a longitudinal pitch of 10 mm.

The ghost image evaluation was performed by printing an arbitrary number of 5 mm-square black marks for one drum (photosensitive member) circumference, followed by printing of a halftone image (at a dot density of 1 dot and 1 space appearing alternately) and alternatively a solid white image over a whole area. The ghost image samples were taken at apparatus development volume levels of F5 (central value) and F9 (lowest density), respectively. The ghost image evaluation was performed at the following 4 ranks based on samples according to totally 4 modes.

Rank 1: No ghost was recognized at all according to any mode.

Rank 2: Slight ghost was recognized according to a specific mode.

Rank 3: Slight ghost was recognized according to all the modes.

Rank 4: Ghost was observed according to all the modes.

The results are inclusively shown in the is following Table 1.

As shown in Table 1, the photosensitive members of Examples provided images with suppressed ghost while retaining a high sensitivity, particularly in a semiconductor wavelength region.

TABLE 1

| | 23° C./55% RH | | | | | | | |
|---|---|---|---|---|---|---|---|---|
| | | | Continual imageformation | | | | | |
| | Initial | | Immediately after | | 15 hours after | | 15° C./10% RH | |
| Example | $V_L$ (volts) | Ghost | $V_L$ (volts) | Ghost | $V_L$ (volts) | Ghost | $V_L$ (volts) | Ghost |
| 1 | 110 | 1 | 105 | 2 | 105 | 1 | 115 | 2 |
| 2 | 110 | 2 | 105 | 2 | 105 | 2 | 115 | 2 |
| 3 | 100 | 2 | 100 | 3 | 100 | 2 | 110 | 3 |
| 4 | 115 | 2 | 110 | 2 | 110 | 2 | 120 | 2 |
| 5 | 105 | 2 | 105 | 2 | 105 | 2 | 115 | 2 |
| 6 | 110 | 2 | 115 | 2 | 115 | 2 | 125 | 3 |
| 7 | 160 | 1 | 150 | 2 | 155 | 2 | 190 | 3 |
| 8 | 130 | 1 | 13 | 1 | 130 | 1 | 140 | 2 |
| 9 | 90 | 2 | 85 | 3 | 85 | 2 | 100 | 3 |
| Comp. 1 | 110 | 3 | 95 | 4 | 95 | 3 | 120 | 4 |
| Comp. 2 | 155 | 2 | 135 | 4 | 140 | 3 | 155 | 4 |
| Comp. 3 | 165 | 2 | 170 | 4 | 165 | 3 | 185 | 4 |

What is claimed is:

1. An electrophotographic photosensitive member, comprising a support and a photosensitive layer disposed on the support and containing an azo calix[n]arene compound of formula (1) below:

(1)

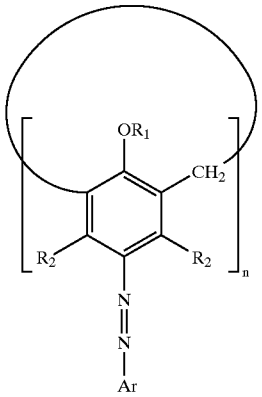

wherein n denotes an integer of 4–8; a number (n) of R1 independently denote a hydrogen atom or an alkyl group capable of having a substituent and including at least one alkyl group capable of having a substituent; a number (2n) of R2 independently denote a hydrogen atom or an alkyl group capable of having a substituent; and a number (n) of Ar independently denote a monovalent group selected from an aromatic hydrocarbon ring group capable of having a substituent, a heterocyclic ring group capable of having a substituent, and a combination of these groups capable of having a substituent;

wherein said photosensitive layer further contains a charge-generating material comprising a phthalocyanine pigment.

2. An electrophotographic photosensitive member according to claim 1, wherein said phthalocyanine pigment comprises oxytitanium phthalocyanine.

3. An electrophotographic photosensitive member according to claim 2, wherein said oxytitanium phthalocyanine has a crystal form characterized by a strong peak at a Bragg angle (2θ±2.0 deg.) of 27.2 deg. according to CuKα-characteristic X-ray diffractometry.

4. An electrophotographic photosensitive member according to claim 3, wherein said oxytitanium phthalocyanine has a crystal form characterized by strong peaks at Bragg angles (2θ±0.2 deg.) of 9.0 deg., 14.2 deg., 23.9 deg. and 27.1 deg. according to CuKα-characteristic X-ray diffractometry.

5. An electrophotographic photosensitive member according to claim 1, wherein said phthalocyanine pigment comprises gallium phthalocyanine.

6. An electrophotographic photosensitive member according to claim 5, wherein said gallium phthalocyanine is hydroxygallium phthalocyanine.

7. An electrophotographic photosensitive member according to claim 6, wherein said hydroxygallium phthalocyanine has a crystal form characterized by strong peaks at Bragg angles (2θ±2.0 deg.) of 7.4 deg. and 28.2 deg. according to CuKα-characteristic X-ray diffractometry.

8. An electrophotographic photosensitive member according to claim 7, wherein said hydroxygallium phthalocyanine has a crystal form characterized by strong peaks at Bragg angles (2θ±0.2 deg.) of 7.3 deg., 24.9 deg., and 28.1 deg. according to CuKα-characteristic X-ray diffractometry.

9. An electrophotographic photosensitive member according to claim 7, wherein said hydroxygallium phthalocyanine has a crystal form characterized by strong peaks at Bragg angles (2θ±0.2 deg.) of 7.5 deg., 9.9 deg., 16.3 deg., 18.6 deg., 25.1 deg., and 28.3 deg. according to CuKα-characteristic X-ray diffractometry.

10. An electrophotographic photosensitive member according to claim 1, wherein said Ar in the formula (1)

includes a benzene ring having a substituent attached thereto selected from cyano group, nitro group, carboxyl group and halogen atom.

11. An electrophotographic photosensitive member according to claim 1, wherein said azo calix[n]arene compound is an azo calix[4]arene compound represented by formula (2) below:

(2)

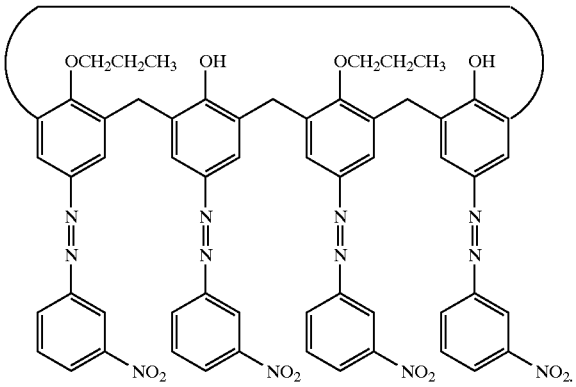

12. An electrophotographic photosensitive member according to claim 1, wherein said azo calix[n]arene compound is contained in a proportion of 0.3–10 wt. % of said charge-generating material.

13. An electrophotographic photosensitive member according to claim 1, wherein said photosensitive layer has a laminated structure including a charge generation layer containing said azo calix[n]arene compound, and a charge transport layer.

14. A process cartridge, comprising: an electrophotographic photosensitive member and at least one means selected from the group consisting of charging means, developing means and cleaning means; said electrophotographic photosensitive member and said at least one means being integrally supported and detachably mountable to a main assembly of an electrophotographic apparatus, wherein said electrophotographic photosensitive member comprises a support and a photosensitive layer disposed on the support and containing an azo calix[n] arene compound of formula (1) below:

(1)

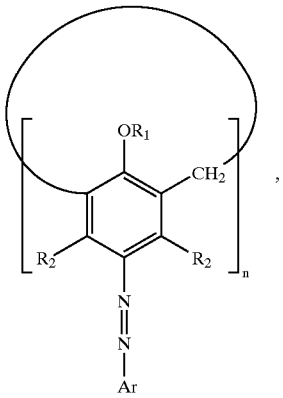

wherein n denotes an integer of 4–8; a number (n) of R1 independently denote a hydrogen atom or an alkyl group capable of having a substituent and including at least one alkyl group capable of having a substituent; a number (2n) of R2 independently denote a hydrogen atom or an alkyl group capable of having a substituent; and a number (n) of Ar independently denote a monovalent group selected from an aromatic hydrocarbon ring group capable of having a substituent, a heterocyclic ring group capable of having a substituent, and a combination of these groups capable of having a substituent;

wherein said photosensitive layer further contains a charge-generating material comprising a phthalocyanine pigment.

15. An electrophotographic apparatus, comprising: an electrophotographic photosensitive member, and charging means, developing means and transfer means respectively disposed opposite to the electrophotographic photosensitive member, wherein said electrophotographic photosensitive member comprises a support and a photosensitive layer disposed on the support and containing an azo calix[n]arene compound of formula (1) below:

(1)

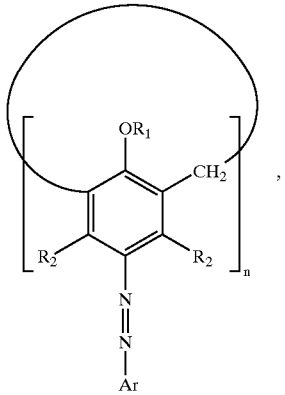

wherein n denotes an integer of 4–8; a number (n) of R1 independently denote a hydrogen atom or an alkyl group capable of having a substituent and including at least one alkyl group capable of having a substituent; a number (2n) of R2 independently denote a hydrogen atom or an alkyl group capable of having a substituent; and a number (n) of Ar independently denote a monovalent group selected from an aromatic hydrocarbon ring group capable of having a substituent, a heterocyclic ring group capable of having a substituent, and a combination of these groups capable of having a substituent;

wherein said photosensitive layer further contains a charge-generating material comprising a phthalocyanine pigment.

16. An electrophotographic photosensitive member according to claim 1, wherein the azo calix[n]arene compound is contained in a proportion of 0.01–1 wt. % of the phthalocyanine pigment.

17. A process cartridge according to claim 14, wherein the azo calix[n]arene compound is contained in a proportion of 0.01–1 wt. % of the phthalocyanine pigment.

18. An electrophotographic apparatus according to claim 15, wherein the azo calix[n]arene compound is contained in a proportion of 0.01–1 wt. % of the phthalocyanine pigment.

* * * * *

UNITED STATES PATENT AND TRADEMARK OFFICE

CERTIFICATE OF CORRECTION

PATENT NO. : 6,465,143 B2
DATED : October 15, 2002
INVENTOR(S) : Masato Tanaka et al.

It is certified that error appears in the above-identified patent and that said Letters Patent is hereby corrected as shown below:

Title page,
Item [57], ABSTRACT,
Lines 10, 13 and 15, “denote” should read -- denotes --.

Column 1,
Line 46, “various-” should read -- various --.

Column 2,
Line 32, “back” should read -- black --.

Column 3,
Lines 22, 25 and 27, “denote” should read -- denotes --.

Column 4,
Lines 19, 22 and 24, “denote” should read -- denotes --.
Line 32, “examples” should be deleted.

Column 8,
Line 60, “iodoeethane,” should read -- iodoethane --.

Column 9,
Lines 59 and 66, “calixarene” should read -- calix[n]arene --.

Column 13,
Line 36, “(274” should read -- (2θ --.

Column 17,
Line 65, “R1” should read -- $R_1$ --.
Line 66, “denote” should read -- denotes --.

Column 18,
Line 2, “R2” should read -- $R_2$ --; and “denote” should read -- denotes --.
Line 4, “denote” should read -- denotes --.

UNITED STATES PATENT AND TRADEMARK OFFICE

CERTIFICATE OF CORRECTION

PATENT NO. : 6,465,143 B2
DATED : October 15, 2002
INVENTOR(S) : Masato Tanaka et al.

It is certified that error appears in the above-identified patent and that said Letters Patent is hereby corrected as shown below:

Column 19,
Line 63, "R1" should read -- $R_1$ --.
Line 64, "denote" should read -- denotes --.

Column 20,
Line 2, "R2" should read -- $R_2$ --; and "denote" should read -- denotes --.
Lines 4, 40 and 45, "denote" should read -- denotes --.
Line 39, "R1" should read -- $R_1$ --.
Line 43, "R2" should read -- $R_2$ --; and "denote" should read -- denotes --.

Signed and Sealed this

Twenty-ninth Day of July, 2003

JAMES E. ROGAN
*Director of the United States Patent and Trademark Office*